United States Patent [19]

Chermin et al.

[11] 4,087,723

[45] May 2, 1978

[54] ARRANGEMENT FOR STARTING AND OPERATING A DISCHARGE LAMP

[75] Inventors: Hubertus Mathias Jozef Chermin; Herman Adrianus Godefridus Smulders, both of Eindhoven, Netherlands

[73] Assignee: U.S. Philips Corporation, New York, N.Y.

[21] Appl. No.: 741,377

[22] Filed: Nov. 12, 1976

[30] Foreign Application Priority Data

Nov. 21, 1975 Netherlands ..... 7513609

[51] Int. Cl.[2] ..... H05B 41/18; H05B 41/36

[52] U.S. Cl. ..... 315/207; 315/243; 315/273; 315/DIG. 7

[58] Field of Search ..... 315/DIG. 7, 207, 237, 315/243, 273

[56] References Cited

U.S. PATENT DOCUMENTS

| | | | |
|---|---|---|---|
| 3,875,459 | 3/1975 | Remery et al. | 315/205 |
| 3,890,539 | 6/1975 | Remery | 315/273 |
| 3,904,921 | 9/1975 | Imaizumi et al. | 315/205 X |

*Primary Examiner*—Alfred E. Smith
*Assistant Examiner*—Charles F. Roberts
*Attorney, Agent, or Firm*—Frank R. Trifari; Bernard Franzblau

[57] ABSTRACT

The invention relates to an arrangement for starting and supplying a discharge lamp provided with cold electrodes. The lamp is shunted by a starter circuit which consists of a series arrangement of at least a capacitor and a controlled semiconductor switching element having a bidirectional thyristor characteristic.

According to the invention a resistor with a positive temperature coefficient is connected in series with the capacitor and the controlled semiconductor switching element. If the lamp fails to ignite the device produces substantially no radio interference owing to the high-ohmic value of the PTC resistor produced by an increase in its temperature. Furthermore, a controlled semiconductor switching element having a low blocking voltage can now be used. Normal starting of the lamp is hardly affected by the PTC resistor.

8 Claims, 1 Drawing Figure

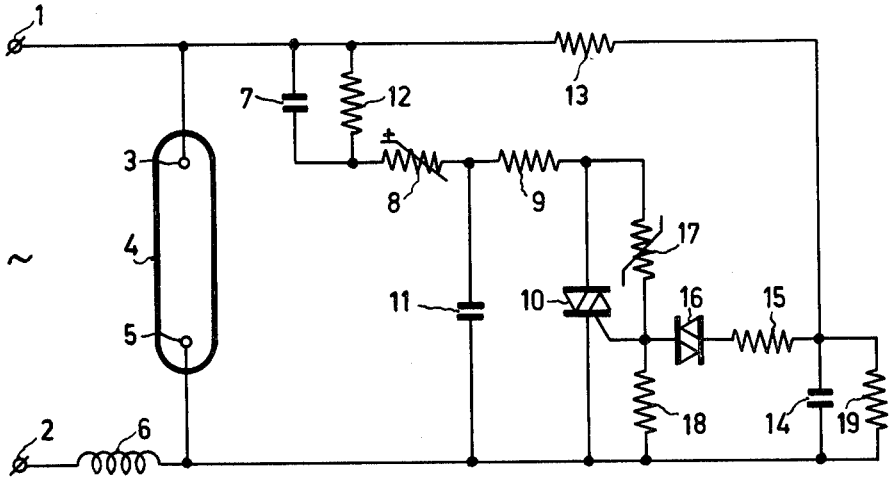
1
2
3
4
5
6
7
8
9
10
11
12
13
14
15
16
17
18
19
~

ARRANGEMENT FOR STARTING AND OPERATING A DISCHARGE LAMP

The invention relates to an arrangement for starting and feeding a discharge lamp which is provided with at least two main electrodes, the arrangement being equipped with two input terminals intended for connection to an alternating voltage source, the two input terminals — during starting of the lamp — being interconnected by a first series arrangement of an inductive stabilisation ballast and the lamp. The two main electrodes of the lamp are interconnected by means of a starting circuit comprising a second series arrangement of at least a capacitor and a controlled semi-conductor switching element with a bidirectional thyristor characteristic. The capacitance of the capacitor is chosen to be so large that during the starting procedure of the lamp — in the conducting state of the semiconductor switching element — the value of the voltage between the main electrodes of the lamp amounts to more than 1.1 times the voltage between the input terminals of the arrangement.

An arrangement of the kind indicated above is, for example, described in the German Gebrauchmuster No. 7035754. When that known device is connected to the voltage source the switching element is made conductive and, owing to a voltage step-up action of the stabilisation ballast together with the capacitor, a relatively high voltage is produced across the lamp electrodes. Thereafter the lamp ignites. A disadvantage of that known arrangement, however, is that if the lamp refuses to ignite the starting circuit remains operative. This is, for example from the point of view of radio interference, injurious. Furthermore, the switching off of the second series arrangement (which interconnects the lamp electrodes) would mean, owing to the large capacitance of the capacitor, that in general the controlled semiconductor element would receive a relatively large blocking voltage due to such a switch-off. This means that this semiconductor switching element must be rated for such high blocking voltages. This is also a disadvantage.

It is an object of the invention to provide an arrangement of the kind mentioned in the preamble in which — in the case of a lamp which refuses to ignite — substantially no radio interference is produced and in which the blocking voltage of the controlled semiconductor switching element may still be relatively small.

An arrangement for starting and feeding a discharge lamp which is provided with at least two main electrodes comprises two input terminals intended for connection to an alternating voltage source, the two input terminals — during starting of the lamp — being interconnected by means of a first series arrangement of an inductive stabilisation ballast and the lamp. The two main electrodes of the lamp are interconnected by a starting circuit comprising a second series arrangement of at least a capacitor and a controlled semiconductor switching element having a bidirectional thyristor characteristic, in which the capacitance of the capacitor has been chosen sufficiently large so that during the starting procedure of the lamp — in the conductive state of the semiconductor switching element — the value of the voltage between the main electrodes of the lamp is more than 1.1 times that of the voltage between the input terminals of the arrangement. The arrangement in accordance with the invention is characterized in that in the second series arrangement a resistor with a positive temperature coefficient is connected in series with the capacitor and with the semiconductor switching element.

An advantage of the arrangement according to the invention is that if the lamp refuses to ignite the current through the second series arrangement causes the generation of heat in the resistor with a positive temperature coefficient (P.T.C. resistor), which causes the ohmic value of this resistor to increase. This means inter alia that the capacitor voltage decreases in the conductive state of the semiconductor switching element. If then thereafter, during its current zero crossing, the semiconductor switching element becomes non-conductive the blocking voltage applied to the semiconductor switching element will be relatively small owing to the reduced capacitor voltage. Consequently the semiconductor switching element need not be rated for high blocking voltages.

In the case of a lamp which fails to ignite, it should also be ensured that the starter is kept out of operation as well as possible. This may, for example, be done by means of an extra auxiliary device in the second series arrangement. Preferably, however, a simpler way is chosen namely by ensuring that the warm P.T.C. resistor is kept warm thereafter, that is to say in its high-ohmic range. One of the methods is to raise the semiconductor switching element to its conductive state from time to time. The high ohmic value of the P.T.C. resistor then ensures that the current strength in the second series arrangement is very small so that there will hardly be any radio interference. Another method to keep the P.T.C. resistor warm might be the use of a high-ohmic shunting circuit across the semiconductor switching element so that it is no longer necessary to raise the semiconductor switching element to the conductive state. Furthermore a combination of both methods is conceivable.

When the first-mentioned method is used, a control circuit of the semiconductor switching element preferably constitutes a shunt of that part of the two series arrangements which comprises this switching element as well as the P.T.C. resistor. An advantage thereof is that the temperature of the P.T.C. resistor can be properly maintained as it does not strongly affect the control circuit.

With either of the two said methods the use of a P.T.C. resistor results in the fact that, owing to its high ohmic value, the current strength through the capacitor is small; that is to say considerably smaller than in the case of a through-connection in the circuit in place of the P.T.C. resistor. This means that the radio interference may be particularly small in the circuit according to the invention.

The discharge lamp may or may not be provided with pre-heatable electrodes.

The resistor with a positive temperature coefficient could, for example, be arranged in such a manner that in the normal operating condition of the lamp the temperature of the resistor is mainly maintained by the heat generation of the lamp.

In a preferred embodiment of an arrangement according to the invention, in which a control circuit of the semiconductor switching element is provided with a threshold element, the voltage across the threshold element remaining below the break-down value in the operating condition of the lamp, the P.T.C. resistor is spatially so arranged that an increase in temperature of that resistor after switching on the device is mainly effected by the electric current through that resistor.

An advantage of this preferred embodiment is that the resistor with a positive temperature coefficient need not be arranged close to the lamp and consequently will not interrupt the light. Furthermore, the resistor with a positive temperature coefficient can now be easily assembled into a starter unit together with the other components of the starter.

It is conceivable that in the operating condition of the lamp the resistor with a positive temperature coefficient assumes such a high-ohmic value that the current through the semiconductor switching element falls to a value below its hold current value and consequently becomes non-conducting. In this case no further influence on the control circuit of the semiconductor switching element is necessary because this element has then already become non-conducting.

It is also possible that only in the case of a lamp which refuses to ignite will the P.T.C. resistor arrive in its high-ohmic range.

An embodiment of the invention will now be described, by way of example, with reference to the accompanying drawing.

In this drawing input terminals 1 and 2 are intended for connection to an a.c. voltage source of approximately 220 volts, 50 Hz. Terminal 1 is connected to a main electrode 3 of a discharge lamp 4 which is only shown symbolically. It is a low-pressure mercury vapour discharge lamp of approximately 65 Watts. Another main electrode 5 of the lamp 4 is connected through a stabilisation inductance 6 to the input terminal 2. The electrodes 3 and 5 are of the non-preheatable type. The electrode 3 is connected to the other main electrode 5 through a so-called second series arrangement which consists of a capacitor 7, a resistor with a positive temperature coefficient (P.T.C. resistor) 8 and a parallel circuit. This parallel circuit consists on the one hand of a series connection of a resistor 9 and a controlled semiconductor switching element 10 with a bidirectional thyristor characteristic (triac) and on the other hand of a capacitor 11. Capacitor 7 is shunted by a resistor 12. Furthermore a control circuit of the switching element 10 is provided which consists of a resistor 13 in series with a capacitor 14. This series arrangement also interconnects the electrodes 3 and 5 of the lamp 4. Connected to a junction of the resistor 13 and the capacitor 14 is a series arrangement consisting of a resistor 15 and a bidirectional threshold element (diac) 16. A control electrode of the semiconductor switching element 10 is connected to the threshold element 16. Furthermore, a spike suppressor 17 is connected between the junction of the resistor 9 and the switching element 10 on the one hand and the junction of threshold element 16 and the control electrode of the element 10 on the other hand. Said last junction is also connected through a resistor 18 to the main electrode 5 of the lamp 4. Finally the capacitor 14 is shunted by a discharge resistor 19.

The circuit described operates as follows. First the case of a normally starting lamp 4 will be considered.

If the terminals 1 and 2 are connected to the indicated a.c. voltage source current will flow in the circuit 1, 13, 14, 6, 2. This current charges the capacitor 14. If in this situation the threshold voltage of the threshold element 16 is attained the bidirectional semiconductor switching element 10 is made to conduct. Then current flows in the circuit 1, 7, 8 and then partly through 9 and 10 and partly through 11 and thereafter through the inductance 6 to terminal 2. Owing to the joint operation of the inductance 6 and the capacitor 7 an effective voltage of approximately 380 volts is produced across the electrodes 3 and 5 of the lamp 4 which is more than 1.1 times the value of the AC supply voltage of 220 volts. Thereupon the lamp ignites. Usually this has had hardly any influence on the temperature of the P.T.C. resistor 8 which therefore remains in the low-ohmic range. The voltage across the main electrode 3 and 5 of the lamp now drops, after ignition, back to the operating voltage of this lamp. This voltage is approximately 100 volts. This is too low to make the threshold element 16 conduct. Therefore the controlled semiconductor switching element 10 becomes conductive no longer. Thus the starter — not counting a very small current through the radio anti-interference capacitor 11 and through the control circuit of the semiconductor switching element — is out of operation.

The case of a lamp 4 which refuses to ignite will now be considered.

As before a voltage is applied across the terminals 1 and 2. Thereupon — as mentioned before — a control pulse will also be developed through the control circuit 13, 14 and the threshold element 16, which pulse will render the element 10 conducting. Thereupon current will again flow in the circuit 1, 7, 8 and then partly through 9, 10 and partly through 11 in parallel therewith, and then through the inductance 6 to the terminal 2. Now, however, it is assumed that the lamp 4 refuses to ignite. This means that the current in said last circuit will continue to flow for a longer time. This results in an increase in the temperature of the P.T.C. resistor 8 so that its resistance value increases. This in turn drops the blocking voltage supplied to the switching element 10 (in its non-conducting state) to a value below 500 volts. With this voltage value the semiconductor switching element can be kept in the non-conducting stage in a very reliable manner. Without the P.T.C. resistor the blocking voltage supplied might have been approximately 900 volts. Thereafter, the semiconductor switching element 10 is not completely put out of operation. Namely, from time to time, this semiconductor switching element 10 is again rendered conducting through the control circuit 13, 14. But the current in the circuit 7, 8, 9, 10, 11 is then, however, considerably smaller than would have been the case in the absence of the resistor 8. The semiconductor switching element 10 is rendered conducting to ensure that the temperature of the resistor 8 is maintained, more specifically in its high-ohmic range.

If the lamp is switched off the capacitor 7 will be discharged through the resistor 12. The capacitor 14 is also discharged through the resistor 19.

The capacitor 11 is a very small value capacitor which assists in countering radio interference. The spike suppressor 17 serves to make the element 10 conduct whenever a dangerously high voltage might cause damage to the element 10. The resistor 18 serves inter alia to avoid undesired noise voltages on the control electrode of the switching element 10.

In a practical embodiment the circuit elements had the following approximate values:

Capacitor 7 — 4 $\mu$F
Capacitor 11 — 10 nF
Capacitor 14 — 100 nF
Inducatance 6 — 0.8 Henry
Resistor 12 — 1 MOhm Resistor 13 — 82 KOhm
Resistor 18 — 1 KOhm
Resistor 19 — 18 KOhm
Resistor 15 — 47 Ohm.

The ohmic value of the resistor 8 with the positive temperature coefficient is approximately 20 Ohms at room temperature. In the case of a failing lamp and a switched-on device this resistance value increases in approximately 5 seconds to approximately 100 KOhms. The semiconductor switching element 10 has a permissible blocking voltage of 500 volts. The threshold voltage of the threshold element 16 is 32 volts.

An additional advantage of the circuit described is that if the lamp does ignite but shows strongly rectifying properties (for example because one main electrode emits while the other main electrode does not) so that impermissibly high direct currents would start flowing through the stabilisation inductance, the P.T.C. resistor ensures that this does not happen. This is a result of the fact that in those half cycles of the AC supply in which the lamp does not carry current (off period) the P.T.C. resistor is heated so that after some time, at the end of those off-periods, the starter no longer ignites the lamp. Said impermissibly high currents through the stabilisation inductance then no longer occur.

An advantage of the device described according to the invention is that if a lamp 4 refuses to ignite substantially no radio interference occurs. This is caused by the high resistance value which the P.T.C. resistor 8 has then assumed. Furthermore, a simple semiconductor switching element 10 with a bidirectional thyristor characteristic whose permissible blocking voltage, as indicated, is low, will do.

What is claimed is:

1. An arrangement for starting and operating a discharge lamp having at least two main electrodes comprising, two input terminals adapted for connection to an alternating voltage source, an inductive ballast, means connecting a first series arrangement comprising said inductive ballast and the lamp across the two input terminals, means interconnecting the two main electrodes of the lamp by means of a starter circuit comprising a second series arrangement including at least a capacitor and a controlled semiconductor switching element having a bidirectional thyristor characteristic, the capacitance of the capacitor being chosen so that during the starting procedure of the lamp, with the semiconductor switching element conducting, the value of the voltage produced between the main electrodes of the lamp is more than 1.1 times that of the voltage between the input terminals of the arrangement, the second series arrangement further comprising a resistor with a positive temperature coefficient connected in series with the capacitor and the semiconductor switching element.

2. An arrangement as claimed in claim 1 further comprising means for supplying a current from the input terminals to the positive temperature coefficient resistor at a level sufficient to maintain said resistor in its high-ohmic resistance range if the discharge lamp fails to ignite after power is applied to said input terminals.

3. An arrangement as claimed in claim 2 wherein said current supplying means includes a control circuit of the controlled semiconductor switching element connected to shunt that part of the second series arrangement which comprises said semiconductor switching element and the resistor with a positive temperature coefficient, so that the current supply of the resistor with a positive temperature coefficient is effected through the semiconductor switching element in the case where the lamp fails to ignite.

4. An arrangement as claimed in claim 1 further comprising a control circuit for the semiconductor switching element which circuit is provided with a voltage threshold element, the control circuit being connected so that the voltage across the threshold element remains below its breakdown value in the operating condition of the lamp, characterized in that the resistor with a positive temperature coefficient is spatially arranged so that an increase in temperature of said resistor after switching on of the device is mainly effected by the electric current through said resistor.

5. An arrangement as claimed in claim 1, characterized in that the controlled semiconductor switching element has a permissible blocking voltage of 600 volts maximum.

6. A lamp starter suitable for an arrangement as claimed in claim 1, the switch being provided with two terminals for connection to two main electrodes of the lamp, respectively, the starter comprising between said terminals a series arrangement of at least a capacitor, a resistor with a positive temperature coefficient and a controlled semiconductor switching element with a bidirectional thyristor characteristic.

7. A device for starting and operating an electric discharge lamp having two main electrodes comprising, a pair of input terminals for applying an AC supply voltage to the device, a ballast impedance, means connecting the ballast impedance and the discharge lamp in a first series circuit across said input terminals, a starter circuit comprising a second series circuit connected to said two main electrodes of the lamp, said second series circuit comprising a capacitor, a PTC resistor and a controlled semiconductor switching element having a bidirectional thyristor characteristic, the capacitance of the capacitor having a value such that during the lamp starting procedure a voltage is produced across said two main electrodes of the lamp which is at least 1.1 times the voltage appearing between said pair of input terminals.

8. A device as claimed in claim 7 further comprising a control circuit for the semiconductor switching element having an output terminal connected to a control electrode of the switching element and a pair of input terminals coupled to the two main electrodes of the discharge lamp, the control circuit including a switching device that removes the ignition voltage from the control electrode of the semiconductor switching element when the discharge lamp is in its normal operating condition.

* * * * *